US011673627B2

(12) United States Patent
Hinteman

(10) Patent No.: US 11,673,627 B2
(45) Date of Patent: Jun. 13, 2023

(54) BOAT WIND AND SPRAY PROTECTION DEVICE

(71) Applicant: Brian Barrett Hinteman, Sayville, NY (US)

(72) Inventor: Brian Barrett Hinteman, Sayville, NY (US)

( * ) Notice: Subject to any disclaimer, the term of this patent is extended or adjusted under 35 U.S.C. 154(b) by 0 days.

(21) Appl. No.: 17/810,605

(22) Filed: Jul. 3, 2022

(65) Prior Publication Data

US 2023/0140140 A1 May 4, 2023

Related U.S. Application Data

(60) Provisional application No. 63/273,447, filed on Oct. 29, 2021.

(51) Int. Cl.
*B63B 17/02* (2006.01)
*B63B 79/40* (2020.01)

(52) U.S. Cl.
CPC ..... *B63B 17/02* (2013.01); *B63B 79/40* (2020.01)

(58) Field of Classification Search
CPC ..... B63B 17/00; B63B 17/02; B63B 19/00; B63B 29/02; B63B 79/00; B63B 79/40
USPC ..... 114/343, 361, 71
See application file for complete search history.

(56) References Cited

U.S. PATENT DOCUMENTS

| | | | | |
|---|---|---|---|---|
| 4,473,026 | A | 9/1984 | Bass | |
| 11,358,681 | B2 * | 6/2022 | Becke | B63B 19/02 |
| 2007/0234942 | A1 | 10/2007 | Van Woodham | |
| 2021/0024176 | A1 | 1/2021 | Becke et al. | |

* cited by examiner

*Primary Examiner* — Lars A Olson
(74) *Attorney, Agent, or Firm* — Culhane Meadows PLLC; Robert Klinger

(57) ABSTRACT

A boat wind and spray protection device which includes at least one panel joined to a coupler-hinge-actuator that is capable of being fixed in relation to a boat. For center console boats, a set of two panels, located on either side of the console of the boat, are designed to open from a position generally parallel and adjacent to the console sides, to an angle and distance sufficient to provide improved passenger protection from wind and spray. The panels may be powered electronically by control buttons that operate electronic actuators, that in turn power the movement of the panels between generally closed to generally open positions, as well as intermediate positions.

20 Claims, 12 Drawing Sheets

BOAT WIND AND SPRAY PROTECTION DEVICE

CROSS-REFERENCE TO RELATED APPLICATION

The present application claims the benefit to U.S. provisional application Ser. No. 63/273,447 filed on Oct. 29, 2021. The entire disclosure is incorporated herein by reference.

FIELD OF THE INVENTION

The present invention relates to wind and spray protection for passengers aboard center console boats and addresses the issue of passengers getting wet or cold as the boat travels in a forward direction.

BACKGROUND OF THE INVENTION

Center console boats typically have limited protection from the elements of wind and sea spray. Most center console boats in the marketplace do not provide a protection area wide enough for the boat's captain and passengers, who often become exposed to uncomfortable levels of spray and wind.

Canvas, Isinglass and clear vinyl products help with solving this problem, but these products can be cumbersome to take on and off, especially during movement of the boat. Current products wear, tear, and can lose transparency with use—limiting visibility for the boat's captain and mates. Flexible clear marine vinyl and canvas panels typically shrink over time, making them increasingly difficult to take on and take off. Buttons and bungees used to connect these products onto the boat become hard to work with as the flexible vinyl and canvas shrink. Lastly, zippers that hold these flexible and shrunken vinyl and canvas components together become worn and difficult to zip and unzip, and seams become compromised.

In view of these facts and circumstances of the current center console boat and boat enclosure marketplaces, a wind and spray protection system as described herein provides heretofore unmet advantages of significantly longer and stronger panel durability, longer lasting panel clarity, elimination of buttons and zippers, and a system that deploys with a speed and ease that promotes more frequent use: keeping captains, mates, and passengers warmer, drier, and more comfortable.

SUMMARY OF THE INVENTION

A boat wind and spray protection device (BWSPD), that includes at least one panel mounted between the boat's console and its interior sidewall (gunwale) in which at least a portion of the panel is extendable from a position generally parallel and adjacent to the console, outward to a distance and angle that expands an area of wind and spray protection during movement of the boat. The panel is operatively connected via a coupler-hinge-actuator to a part of the boat's structure or to an intermediary support connected to the boat structure. A coupler-hinge-actuator is herein defined as a combination of a coupler, a hinge, and an actuator.

The panel is preferably made of transparent, rigid, or semi-rigid materials such as acrylic, glass, fiberglass, Lexan, and plastic.

Four preferred embodiments of the coupler-hinge-actuator are provided, including a rotating shaft (rotoshaft)-hinge-actuator, a clamp-hinge-actuator, a track-hinge-actuator and a mount-hinge-actuator The actuator component of the coupler-hinge-actuator may include a rotating actuator, hydraulic actuator, a pneumatic actuator, an electrically operated extendable ram device, and a linear motor that control the speed, distance, and angle of the panel's extension.

Manual release devices for the embodiments are illustrated, which allow for panels to be disengaged from the actuators to swing freely in case of boat loss of power.

The coupler-hinge-actuators are electronically controlled, and at least one electronic controller governs the actuators. Speed monitoring equipment such as GPS and circuit board combination may control the maximum boat traveling speed at which coupler-hinge-actuators can be engaged while the boat is moving.

BRIEF DESCRIPTION OF THE DRAWINGS

The drawings are of preferred embodiments. They do not illustrate all embodiments. Other embodiments may be used in addition or instead. Details which may be apparent or unnecessary may be omitted to save space or for more effective illustration. Some embodiments may be practiced with additional elements or without all the elements illustrated. When the same numeral appears in different drawings, it generally refers to the same or like elements.

DETAILED DESCRIPTION OF THE INVENTION

The present invention is described in enabling detail in the following examples, which represent more than one embodiment of the present invention. When the same numeral appears in different drawings, it generally refers to the same or like elements.

A first example of the Boat Wind and Spray Protection Device (BWSPD) is referred to in FIGS. 1-4. In this embodiment, a panel 103 is joined to at least one coupler-hinge-actuator, exemplified in FIG. 1 by a rotoshaft-hinge-actuator 100. The rotoshaft-hinge-actuator 100 comprises various components described further below, including for example rotoshaft 102. The panel may be comprised of acrylic, glass, fiberglass, Lexan, plastic, and/or combinations thereof.

Figure 1:
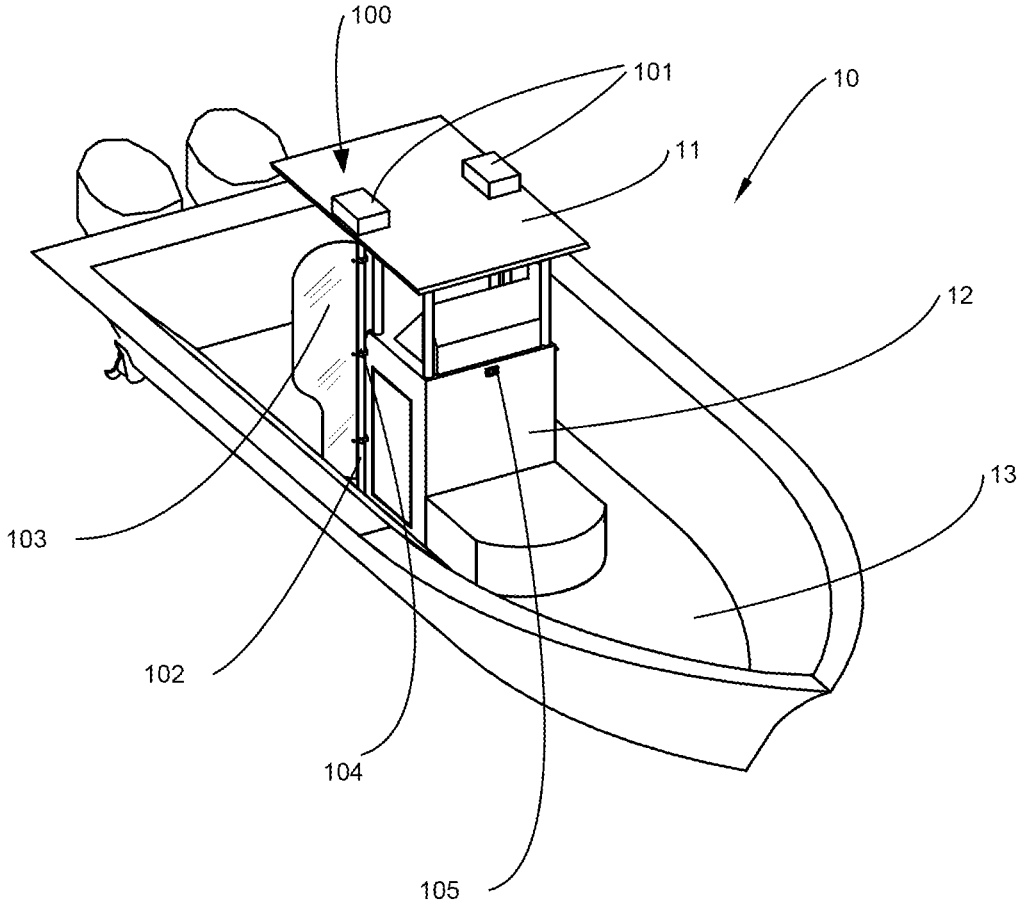
FIG. 1 is a perspective view of a first exemplified embodiment of the Boat Wind and Spray Protection Device (BWSPD) as installed on a center console boat.

As illustrated in FIG. 1, the rotoshaft-hinge-actuator 100 is joined to the boat 10 at the roof 11 and the deck 13. In an alternative embodiment, the rotoshaft-hinge-actuator 100 may be joined to another part of the boat including the console, boat frame, windshield, or other parts of the boat.

Figure 2:
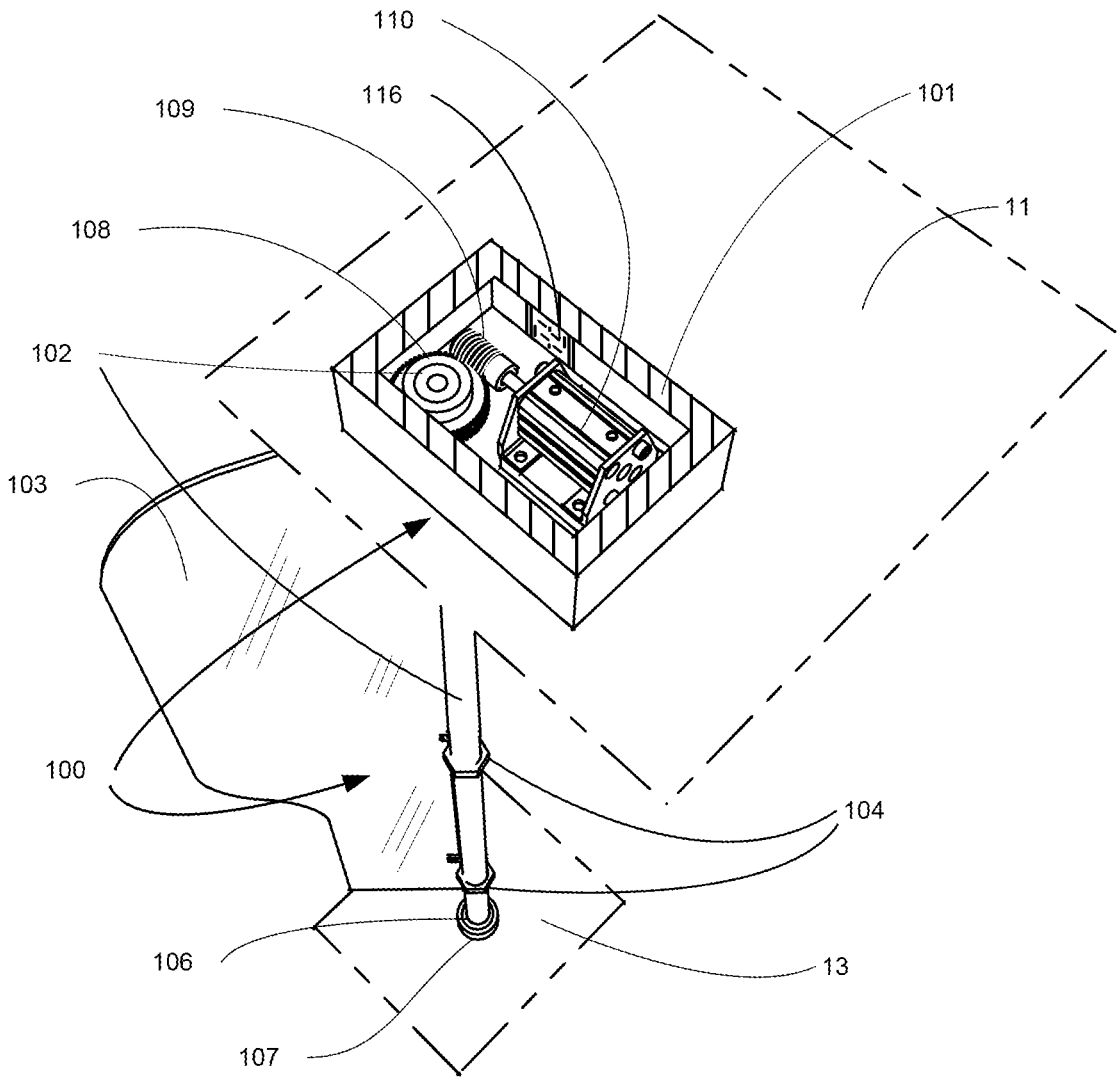
FIG. 2 is an upper perspective view of a first exemplified embodiment, illustrating a rotoshaft-hinge-actuator with a cutaway view of a rotoshaft-rotating mechanism, a panel according to the embodiment, and some of the mounting devices included in embodiment.

FIG. 2 illustrates an upper perspective of a first embodiment, showing a cutaway view of an actuator-gear box 101 containing an electric motor 110 that turns a worm gear 109 that turns a shaft gear 108 that subsequently turns a rotoshaft 102, which has the panel 103 affixed to the rotoshaft 102 by at least one panel support clamp 104 or other suitable connecting mechanism. As an example, in an example of an alternative connecting mechanism, the panel 103 could be joined to the rotoshaft 102 using a keyed or extruded shaft.

The rotoshaft 102 rotates around pivot points on the roof of the boat 11 and the deck of the boat 13. The electric motor 110 may have built-in and/or adjustable limits to control degrees of rotation of the rotoshaft 102 and panel 103. GPS components including a circuit board 116 may also prevent or limit the rotation of the rotoshaft 102 in appropriate circumstances, for example it may limit situations where panels may be deployed such as when the boat is traveling at high speed. An optional warning device may be included to sound if the boat is traveling at a speed at which the panels should not be deployed.

Figure 3:
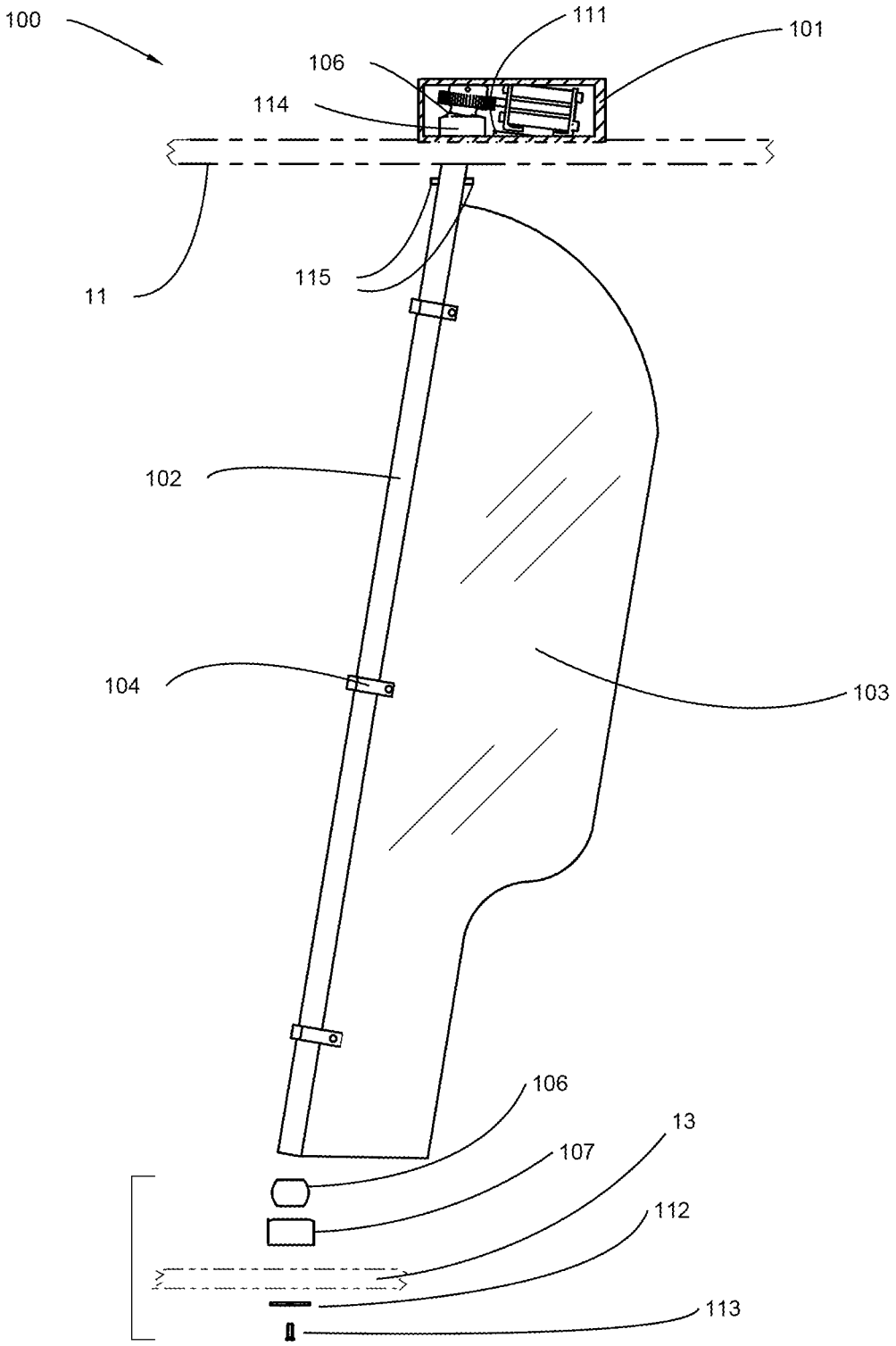
FIG. 3 is a side view of a first exemplified embodiment as aligned to an angled position, with a cutaway view of the rotoshaft rotating mechanism, and an exploded view of how the device could attach to the deck of the boat.

In the FIG. 3 side view example of the BWSPD, the rotoshaft 102 is angled between the roof 11 and deck 13 of the boat. In this example, this angled position is enabled by a rotatable bearing device, for purposes of this example a spherical bearing 106 is illustrated, that is joined to the rotoshaft 102 and which in turn is mounted into a deck anchor 107 and a roof anchor 114. The exploded view at the bottom of FIG. 3 illustrates the device-to-deck connection, with bolt 113, washer 112, deck anchor 107 and spherical bearing 106 joining the BWSPD to the deck 13, A shaft manual release device 115 may be installed to allow for the panel to swing freely in the event of boat power loss or other need to free the panel.

Figure 4A:
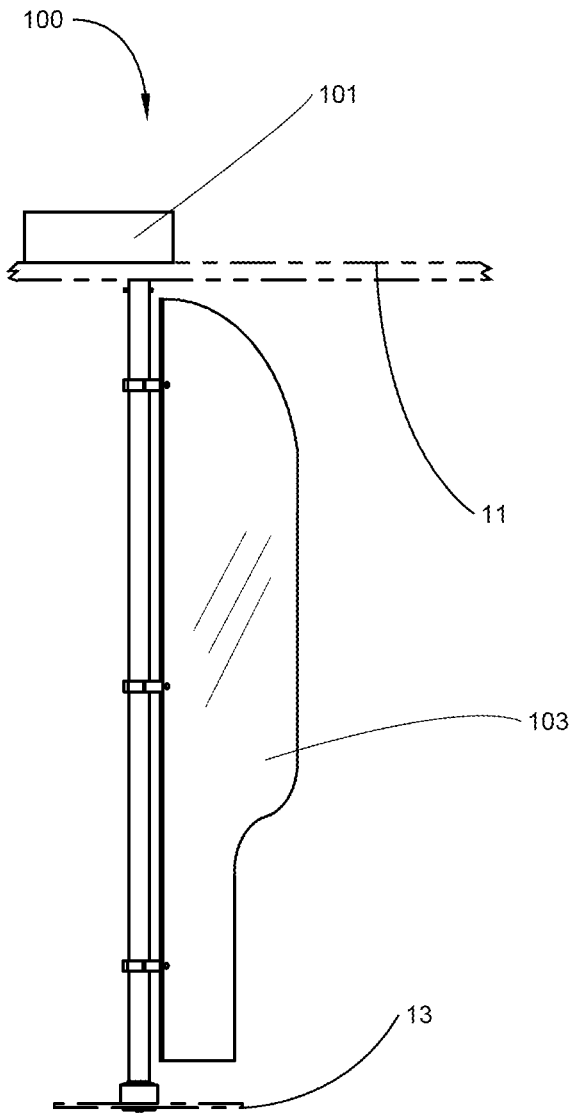
FIG. 4A is a side view of a first exemplified embodiment as mounted closer to the aft side of a roof of a center console boat.
Figure 4B:
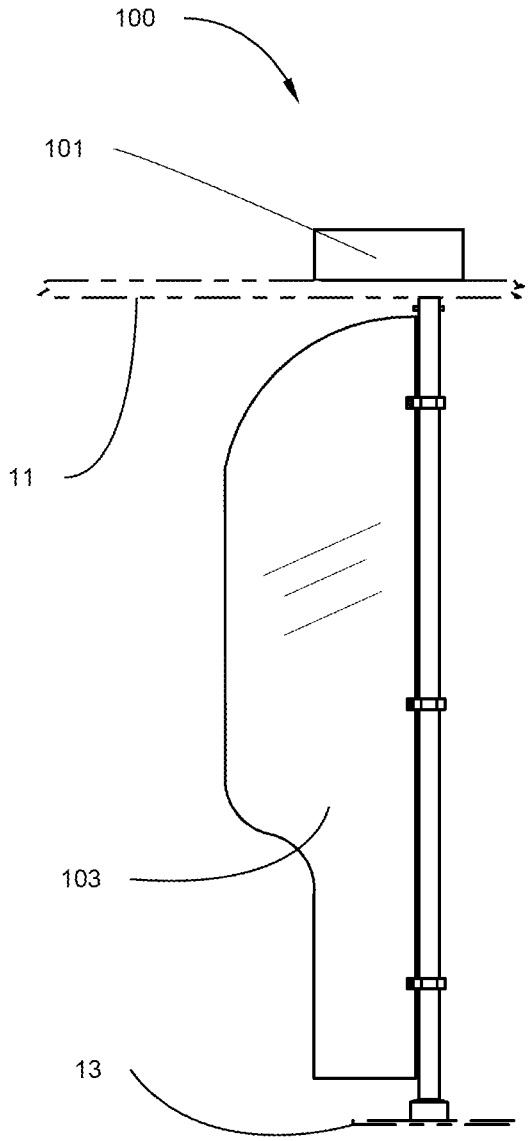
FIG. 4B is a side view of a first exemplified embodiment as mounted closer to the fore side of the roof of a center console boat.

FIG. 4A illustrates the BWSPD as mounted closer to the aft side of the boat's roof 11 in a generally closed position, and FIG. 4B shows the BWSPD as mounted closer to the fore side of the boat's roof 11, also in a generally closed position.

In the example discussed above, the rotoshaft-hinge-actuator 100 is fixed in place relative to the boat structure by direct attachment to roof 11 and deck 13. In variations of the first embodiment, the rotoshaft-hinge-actuator 100 may be secured by other means, whether to another part of the boat or to one or more installed support structures. Other suitable parts of the boat may include the console or boat frame, for example. One or more installed support structures may include a pole, a shaft, a bar, a track, a roof clamp, an adhesive, a welded mounting point, and/or combinations of these or other installed support structures, for example.

Figure 5B:
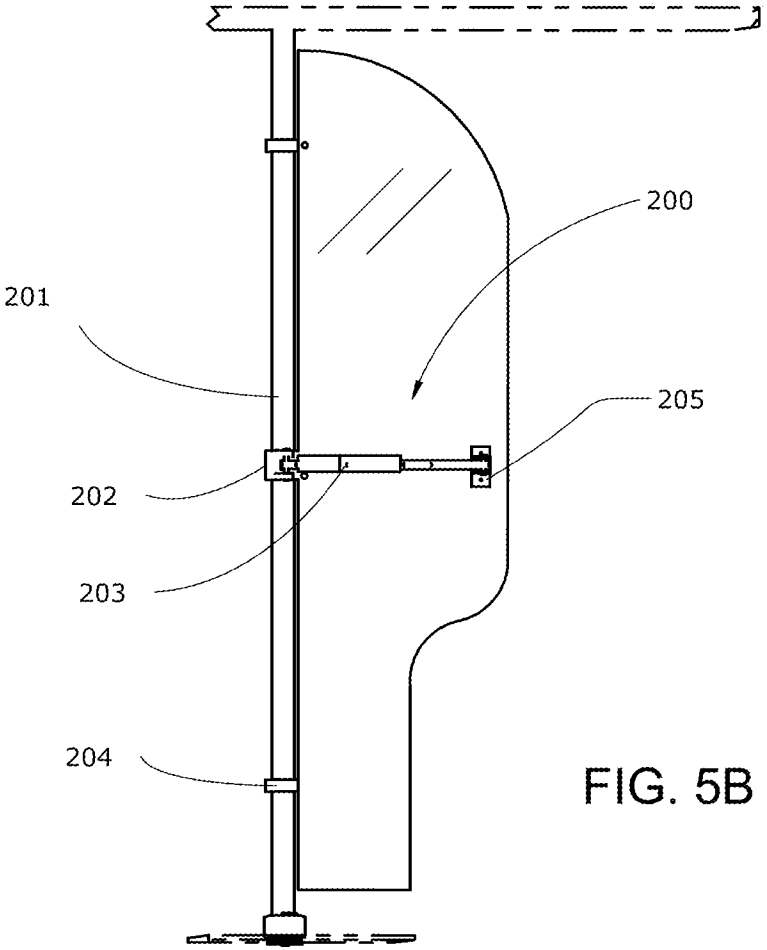
FIG. 5B is a view of the clamp-hinge-actuator of FIG. 5A from the opposite side.
Figure 5A:
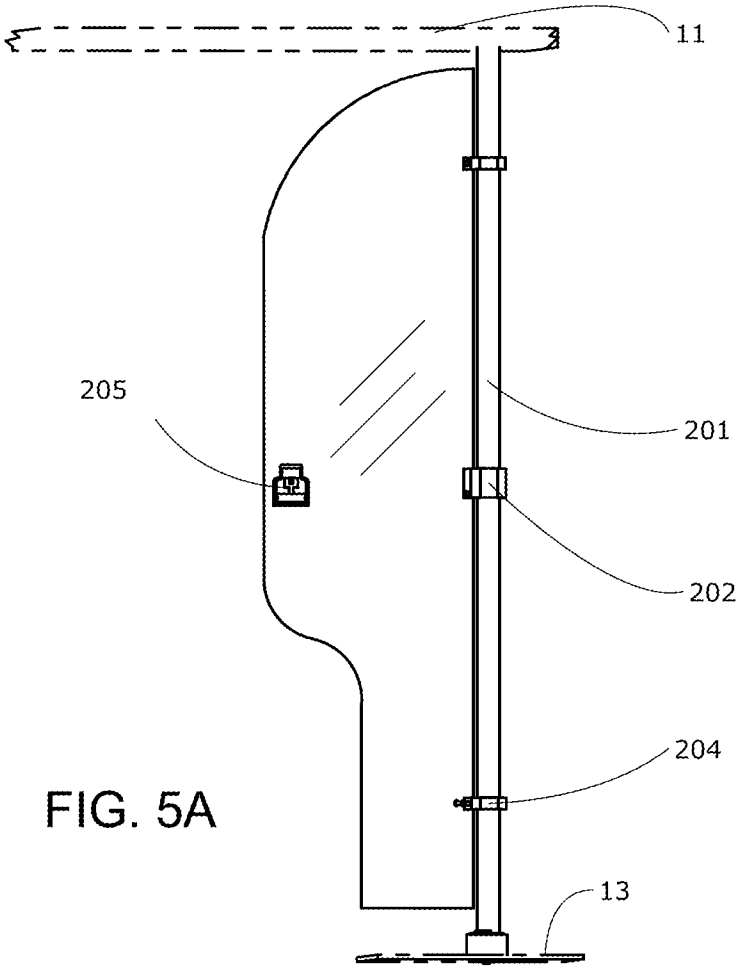
FIG. 5A is a side view of a second exemplified embodiment of the BWSPD, a clamp-hinge-actuator, as joined to a frame support of a boat, in a panel-closed position.

A second embodiment of the Boat Wind and Spray Protection Device (BWSPD) involving a preferred coupler-hinge-actuator embodiment is referred to in FIGS. 5A-8. In this embodiment, a coupler-hinge-actuator is exemplified by a clamp-hinge-actuator 200. FIGS. 5A and 5B illustrate side views of the clamp-hinge-actuator embodiment as attached to panel 103. When deployed, the side of the panel with the linear actuator 203, which will be referred to as the back, generally faces aft; when retracted it generally faces the center console. The opposite side, which is viewed from the bow of the boat when deployed, will be referred to as the front.

Figure 6A:
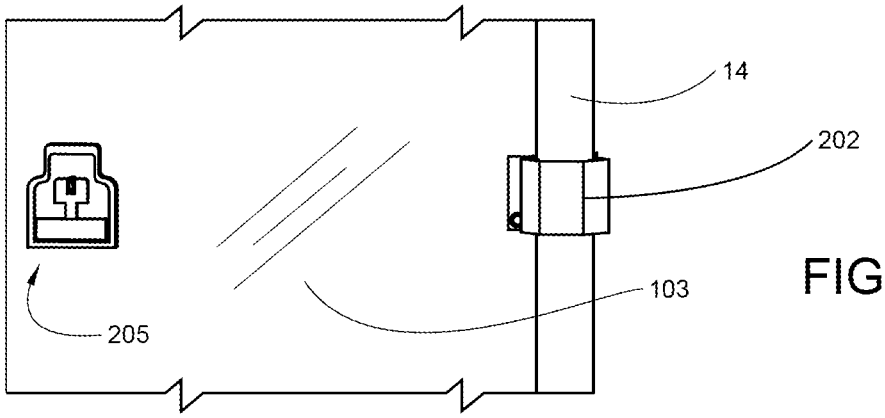
FIG. 6A is a closeup side view of a clamp-hinge-actuator embodiment, illustrating a manual release.
Figure 6B:
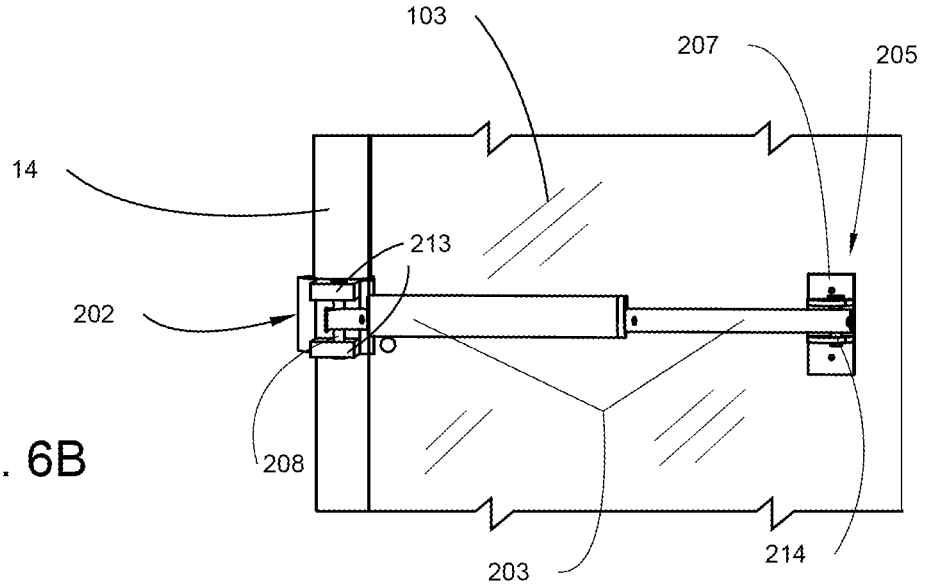
FIG. 6B is a closeup side view of the clamp-hinge-actuator embodiment of FIG. 6A from the opposite side.
Figure 6C:
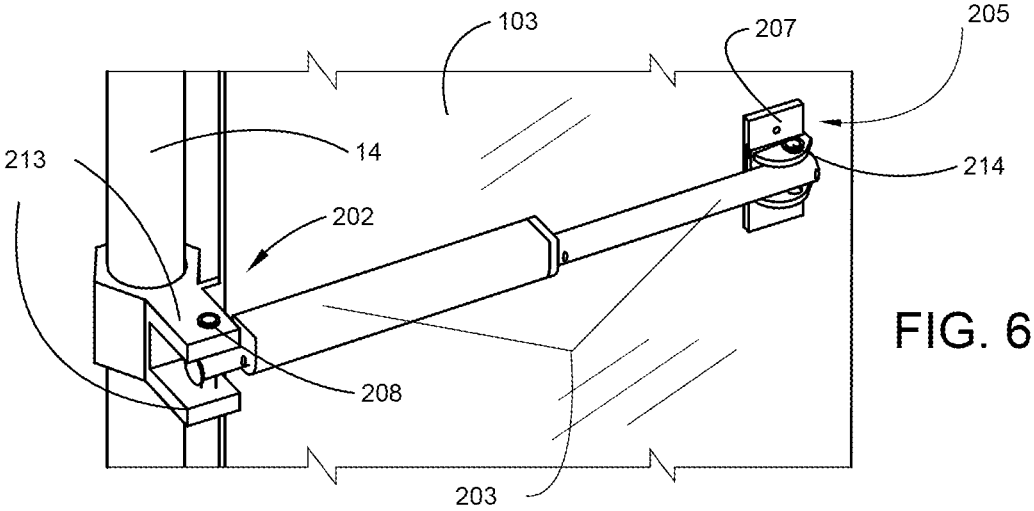
FIG. 6C is a perspective view of a clamp-hinge-actuator and an example of a manual release of the second embodiment.

This example is further illustrated in the close-up FIGS. 6A, 6B and 6C. FIG. 6A and illustrates the front view while FIG. 6B illustrates the back view of the clamp-hinge 202, actuator 203, and actuator manual release 205. FIG. 6C illustrates a close-up perspective view of the clamp-hinge 202 to actuator 203 connection.

The actuator 203 is pivotally attached at the large end by an actuator hinge pin 208, which is connected to clamp extension bars 213, part of the clamp-hinge 202. Actuator 203 thus is not directly connected to a boat structure such as the center console but rather is connected to clamp-hinge 202 with extension bars 213 that create an offset from panel 103. Such an integral offset provided by clamp hinge 202 via extension bars 213 ensures operability of actuator 203 without the need to determine appropriate boat mounting locations for the actuator 203, and generally avoids the need to mount intrusive attachments to boat structure at all. In the example illustrated in FIGS. 6A, 6B and 6C, clamp-hinge 202 is clamped to one of the boat's roof support poles 14. The small end of actuator 203 is pivotally connected to hinge pin 214 which in turn is connected to the manual release device 205. The manual release 205 enables panel 103 to be separated from the actuator 203 in the event of boat power loss or other need to free the panel. The linear actuator 203 may comprise a hydraulic, pneumatic, or electrically operated extendable ram device.

Figure 7A:
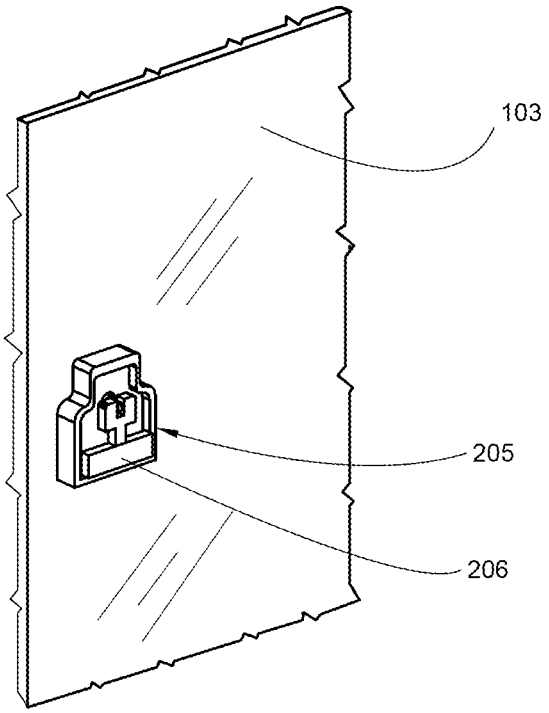
FIGS. 7A, 7B, 7C and 7D are closeup perspective views of the second embodiment, showing an exemplified manual release handle in its various positions when releasing a panel that is joined to the clamp-hinge-actuator.
Figure 7B:
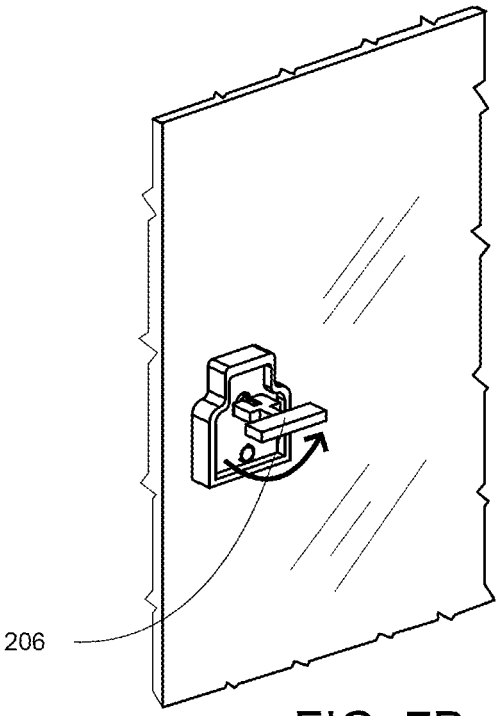
Figure 7C:
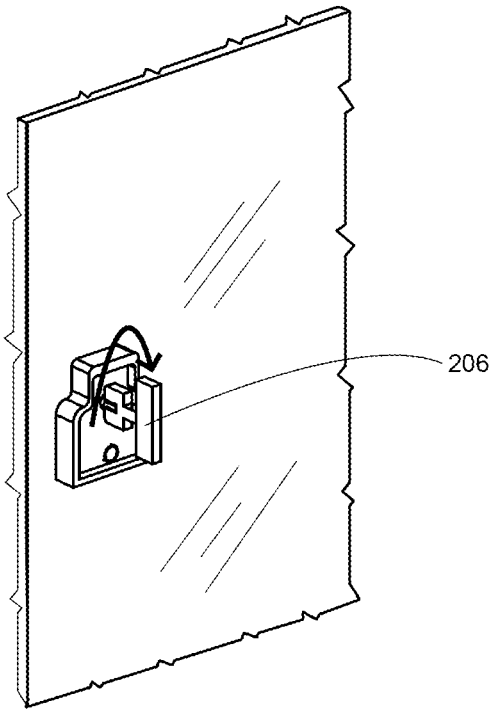
Figure 7D:
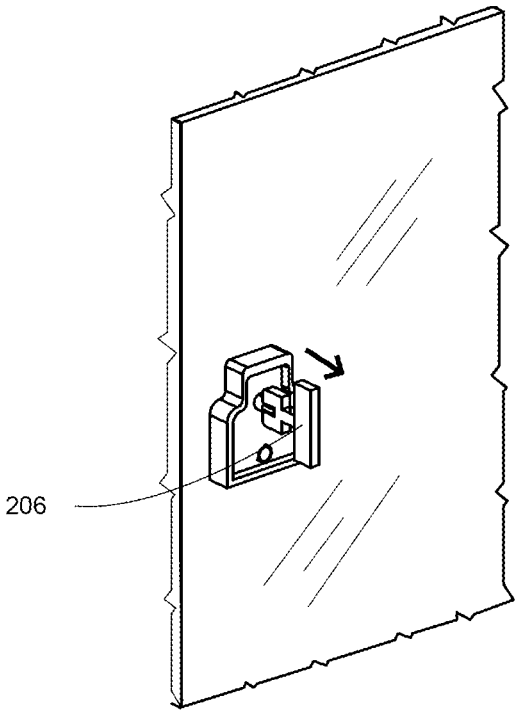

FIGS. 7A-7D illustrate the method for releasing panel 103 from actuator 203 (not shown; see FIGS. 6A-6C) according to the current embodiment. In FIG. 7A, handle 206 is shown in a locked with panel attached position. To release the panel 103, handle 206 is pulled upwards as can be seen in FIG. 7B, then turned clockwise as seen in FIG. 7C, then pulled outwards as illustrated in FIG. 7D.

Figure 8:
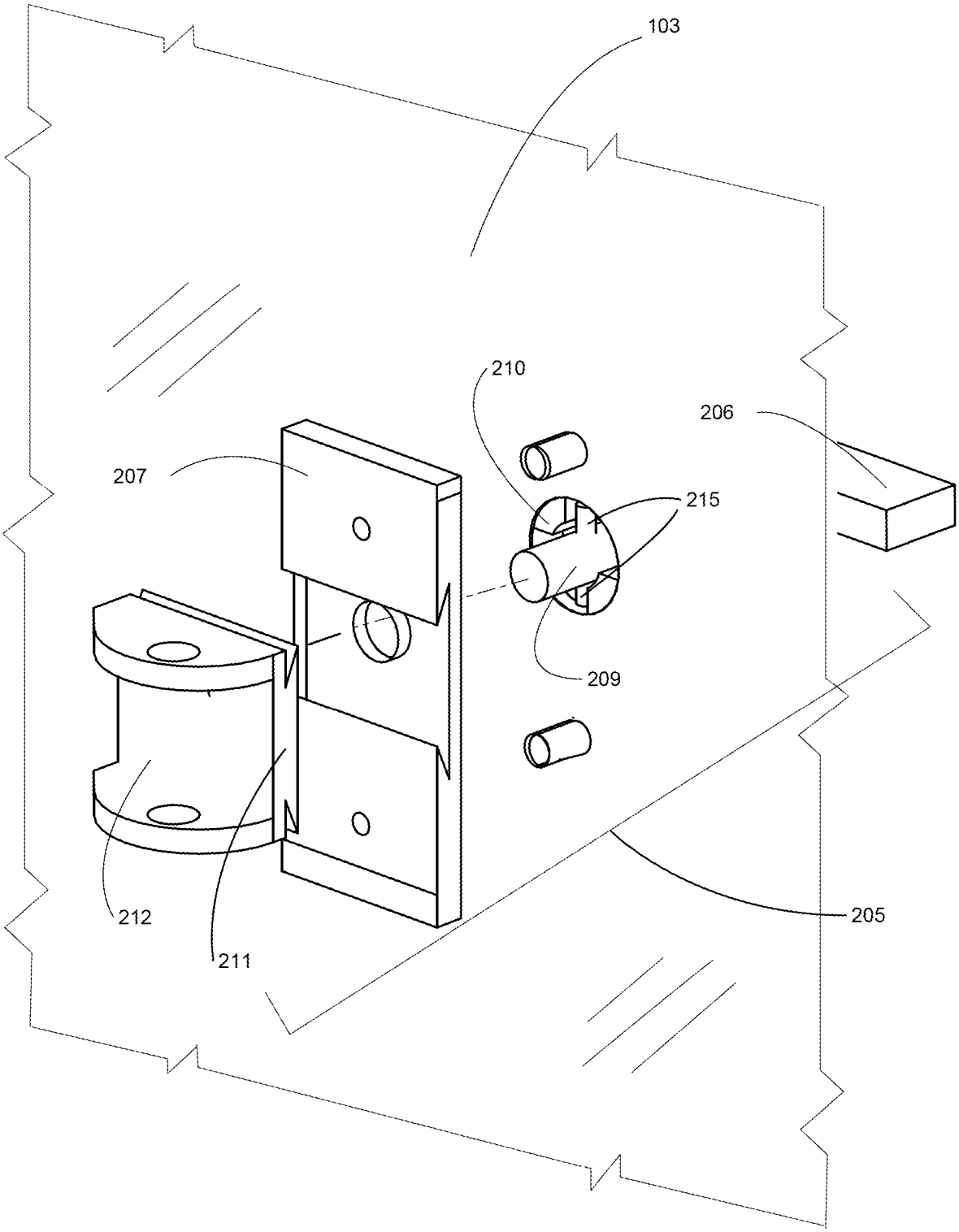
FIG. 8 is a closeup perspective view of the second exemplified embodiment, showing in an exploded view of how the back of a manual release may attach to a panel.

FIG. 8 illustrates an exploded view of a back side of manual release 205, wherein a T-bar 209 rotates inside of a cog 210 as handle 206 is turned. In the locked position, a portion of T-bar 209 protrudes through panel actuator back plate 207 into a dovetail portion 211 of actuator connector 212 thereby locking connector 212 in place, and with T-bar end pins 215 locking T-bar 209 in place. As handle 206 is turned and pulled outwards, T-bar 209 pulls away from dovetail 211, allowing connector 212 and thus panel 103 to slide freely away from the linear actuator 203.

In other examples of this embodiment, the clamp-hinge 202 may be clamped to other parts of the boat amenable to being gripped by a clamp, whether it may be part of a pole, the console, boat frame, or other parts of the boat.

Figure 9A:
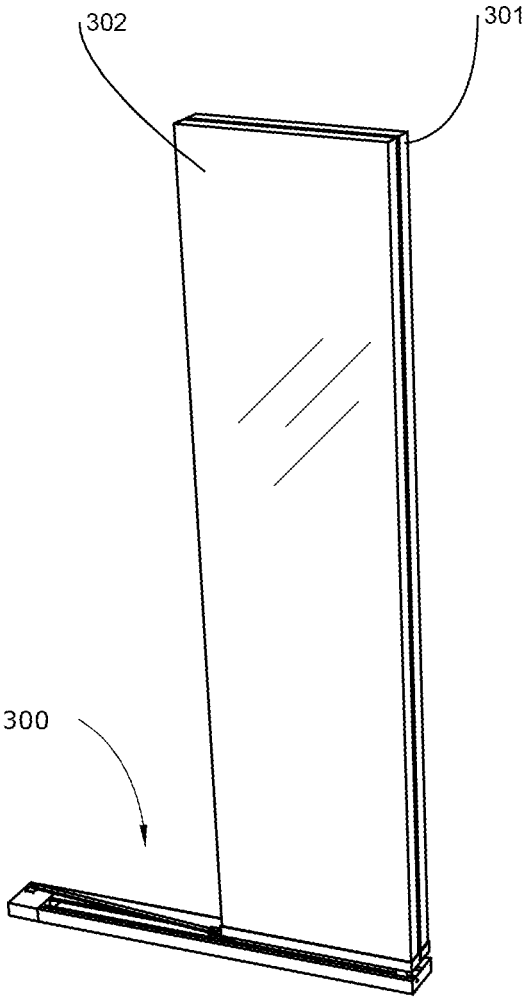
FIG. 9A is a perspective view of a third exemplified embodiment of the BWSPD, a track-hinge-actuator, in a panel-closed position.
Figure 9B:
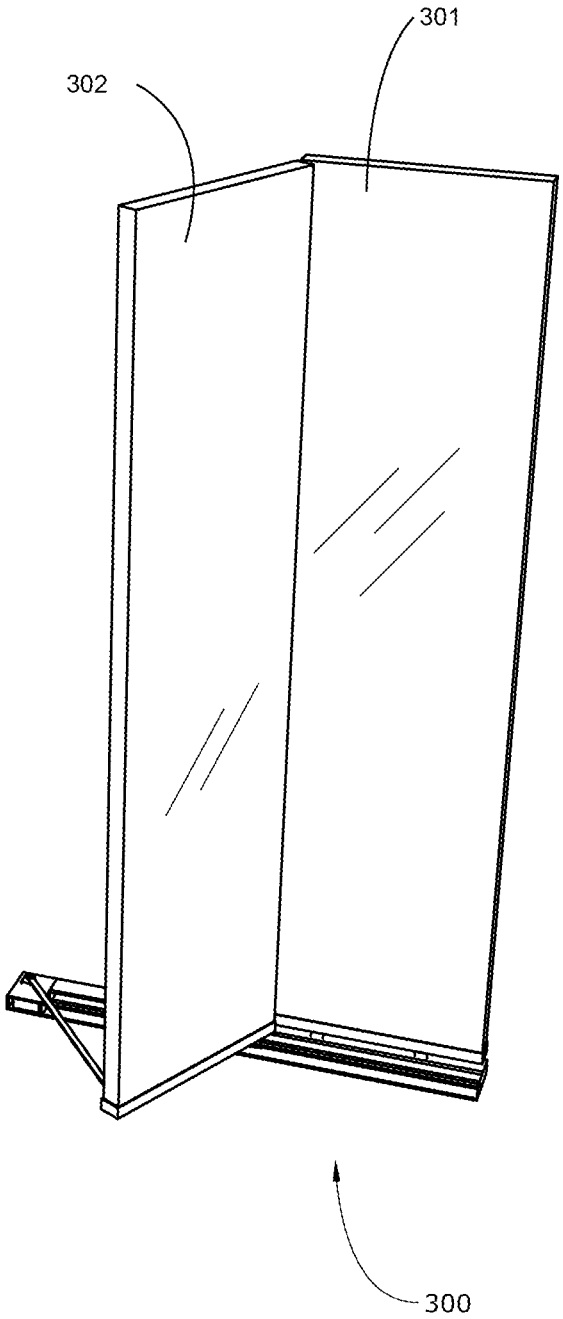
FIG. 9B is a perspective view of the third exemplified embodiment, in a panel-open position.
Figure 10:
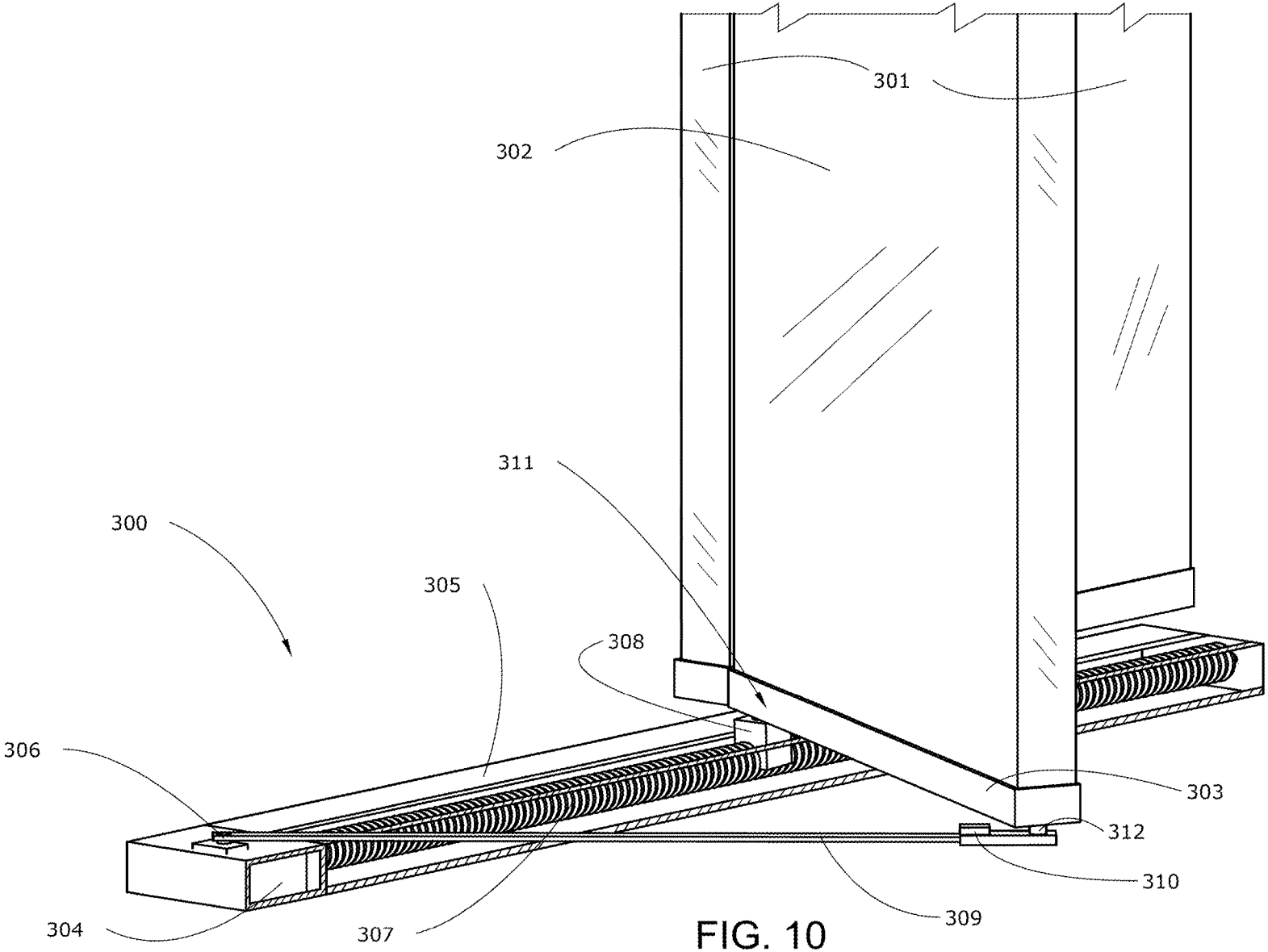
FIG. 10 is a closeup perspective view of the third exemplified embodiment, showing a cutaway of the track-hinge-actuator.

FIGS. 9A-10 illustrate a third embodiment of the Boat Wind and Spray Protection Device (BWSPD). In this example, the coupler-hinge-actuator is exemplified by a track-hinge-actuator 300. Perspective view FIG. 9A shows a set of panels, outside panel 302 and inside panel 301 as mounted to a track-hinge-actuator 300. In this embodiment, the inside panel 301 remains stationary while the track-hinge-actuator 300 guides the outside panel to open in an angled position outward as seen in FIG. 9B. The mechanism of action is described below. In FIGS. 9A and 9B, the track-hinge-actuator 300 is mounted to the deck. In another embodiment, a track or track-hinge-actuator 300 may additionally or alternatively be mounted to the roof to help guide the panels and keep them stable. Whether mounted to the deck or the roof, a person skilled in the art will understand that the mechanism of action in either instance is substantially the same and each are within the scope of this preferred embodiment, as claimed.

FIG. 10 is a cutaway of FIG. 9B from a different perspective angle. As illustrated, panel 302 is connected (indirectly through panel support frame 303) to a track traveler 308. In FIG. 10, track-hinge-actuator 300 is at least partially deployed and the edge of panel 302 connected to track traveler 308 is approximately in the middle of track-hinge-actuator 300. In contrast, in the configuration represented by FIG. 9A, prior to deployment, that same edge of panel 302 connected to track traveler 308 was at the distal (toward the bow of the boat) end of the track-hinge-actuator 300 from the perspective view represented in FIG. 10. The additional description immediately below of the details of the track-hinge-actuator 300 explains how movement of the edge of panel 302 connected to track traveler 308 from the distal position towards the stern to the middle position is accomplished, and how other components of track-hinge-actuator 300 work in cooperation to cause the deployment shown in FIG. 10.

As can be seen in the cutaway portion of FIG. 10 the track-hinge-actuator 300 comprises a mechanical actuator 304 that turns a drive gear 307 that moves track traveler 308 joined to panel support frame 303 that supports and is attached to panel 302. When opening panel 302, rotation of drive gear 307 causes track traveler 308 to move towards the stern toward the middle position noted above, in turn causing compressive force on a pivot arm 309. Based on the initial angle that pivot arm 309 forms with panel when panel 302 is in the fully closed position, which is determined in part by the position of pivot point 306 in relation to pivot point 311, this compressive force causes pivot arm 309 to swing out, causing deployment of panel 302 to a desired position angling outward.

In the event of loss of boat power or other need to free the panel, a manual release 310 (which may be a foot release in a deck-mounted configuration, as an example) may be activated to disengage the panel support frame 303, releasing it from pivot arm 309 and allowing panel 302 to swing freely.

In an alternative embodiment the track-hinge-actuator 300 may be joined to another part of the boat including the console, boat frame, or other parts of the boat.

Figure 11:
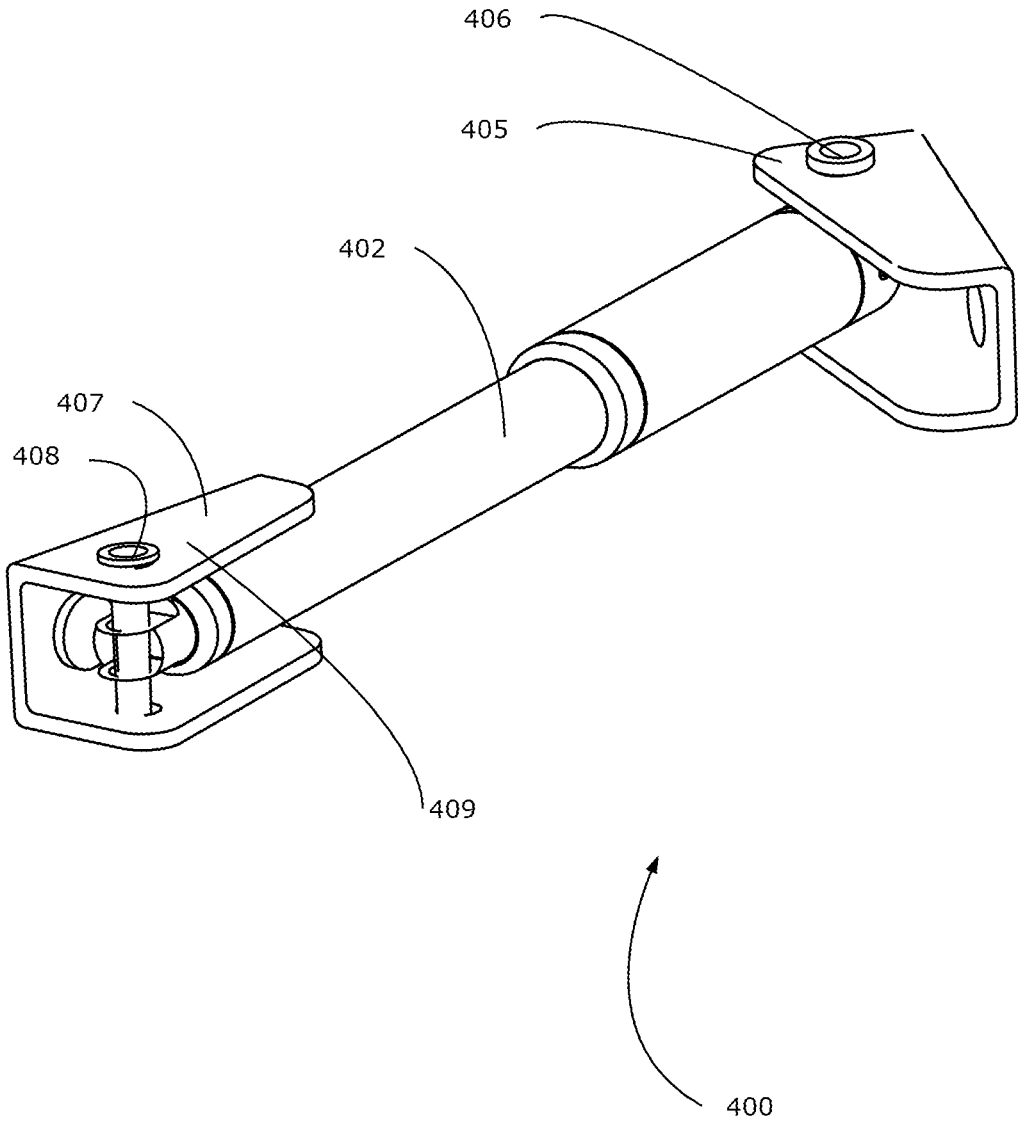
FIG. 11 is a perspective view of the mount-hinge-actuator.

FIG. 11 illustrates a mount-hinge-actuator that uses a linear actuator 402 that pivotally attaches to a boat mount 405 at one end by an actuator hinge pin 406, The panel mounting end of actuator 403 is pivotally connected to hinge pin 408 which in turn is connected to a panel. The linear actuator 403 operates to extend and retract the panel, and may comprise a hydraulic, pneumatic, or electrically operated extendable ram device.

Figure 12A:
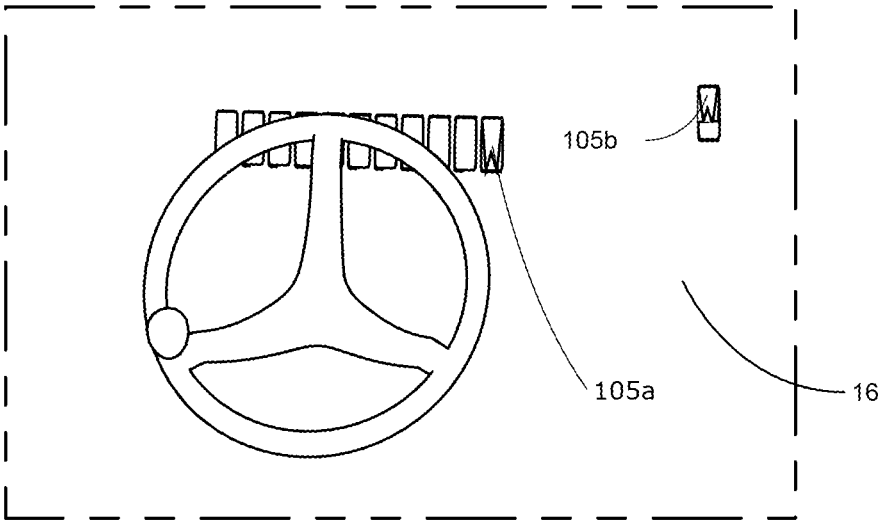
FIG. 12A is a closeup front view of a boat's dashboard, illustrating potential locations for an electronic controller installed on the aft side of a boat's console, on the dashboard, configured to govern electronic components in various embodiments of the BWSPD.
Figure 12B:
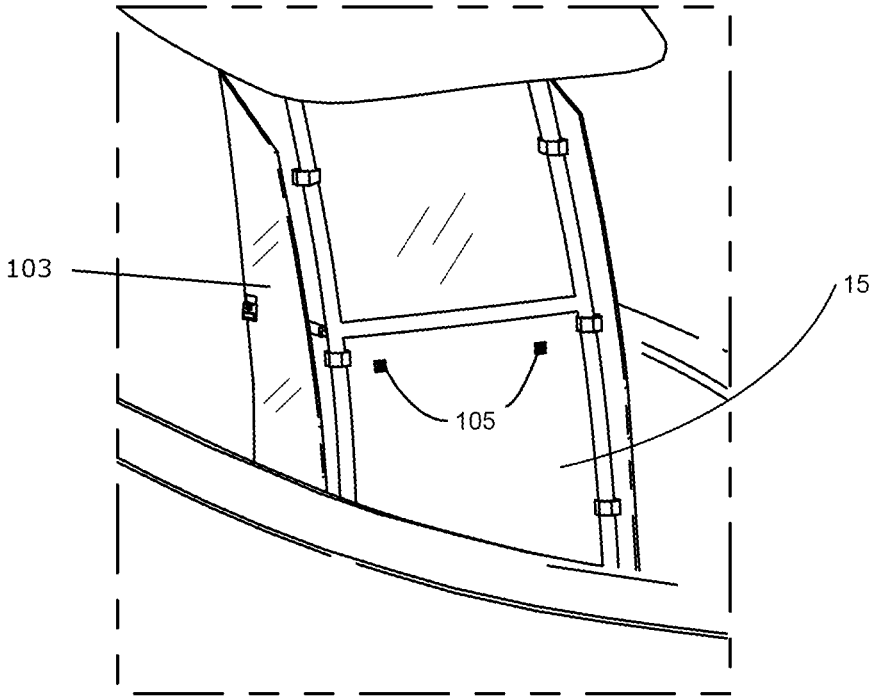
FIG. 12B is a perspective view of a front portion of a boat, with electronic controllers installed on the fore side of a boat's console configured to govern electronic components in various embodiments of the BWSPD.

As can be seen in FIGS. 12A and 12B, electronic controller 105 may be included to govern control of the actuators. Such control may include movement between generally open and generally closed positions, as well as intermediate positions. Such electronic controller 105 may also be a combination of multiple controllers and may be in alternative locations such as positions 105*a* and 105*b*. The electronic controllers may be installed on any convenient part of the boat. In this example, an electronic controller mounted on a boat's dashboard 16 can be installed as an accessory switch 105*a* or a stand-alone switch 105*b*, and electronic controllers may be installed on the front of the boat console 15, as exemplified by electronic controllers 105 in FIG. 12B.

It will be apparent to one with skill in the art that the Boat Wind and Spray Protection Device may use some or all the mentioned features and components without departing from the spirit and scope of the present invention. It will also be apparent to the skilled artisan that the embodiments described above are specific examples of a single broader invention which may have greater scope than any of the singular descriptions taught. There may be alterations made in the descriptions without departing from the spirit and scope of the present invention.

What is claimed is:

1. A boat wind and spray protection device comprising at least one panel mounted between the boat's console and its interior sidewall, wherein at least a portion of the panel is extendable from a position generally parallel and adjacent to the console, outward to a distance and angle that expands an area of wind and spray protection device during movement of the boat, wherein the panel is joined to at least one coupler-hinge-actuator that is capable of being fixed in place relative to the boat's structure, further comprising speed monitoring equipment capable of governing operation of the coupler-hinge-actuator to a boat speed at which the coupler-hinge-actuator may be deployed.

2. The boat wind and spray protection device according to claim 1, wherein said panel comprises at least one material selected from the group consisting of acrylic, glass, fiberglass, plastic, and combinations thereof.

3. The boat wind and spray protection device according to claim 1 wherein the coupler-hinge-actuator is a rotoshaft-hinge-actuator.

4. The boat wind and spray protection device according to claim 1, wherein the coupler-hinge-actuator is a clamp-hinge-actuator.

5. The boat wind and spray protection device according to claim 1 wherein the coupler-hinge-actuator is a track-hinge-actuator.

6. The boat wind and spray protection device according to claim 1 wherein the coupler-hinge-actuator comprises at least one actuator selected from the group consisting of a hydraulic actuator, a pneumatic actuator, a rotating actuator, an electrically operated extendable ram device, and a linear motor, that controls the speed, distance, and angle of the panel's extension.

7. The boat wind and spray protection device according to claim 1 wherein the coupler-hinge-actuator can be disengaged from the panel by a manual release.

8. The boat wind and spray protection device according to claim 1 wherein the coupler-hinge-actuator is electronically activated and is governed by at least one electronic controller.

9. The electronic controller according to claim 8, further comprising a warning device that sounds if the coupler-hinge-actuator is electronically activated while the boat is traveling at a speed at which the panels should not be deployed.

10. A boat, comprising:

a floor;

a sidewall;

a console coupled to the floor and separated from the sidewall;

a roof; and a wind and aye protection device having a first member selectively coupled to and extending between the floor and the roof, a first side panel coupled to the first member and extending between the console and the sidewall, wherein a first actuator is configured to rotate the first side panel with respect to the console.

11. The boat of claim 10, wherein the first actuator is coupled between the first member and the first side panel.

12. The boat of claim 10, wherein the first actuator is configured to rotate the first member.

13. The boat of claim 12, wherein the first actuator is coupled to the roof.

14. The boat of claim 10, wherein the wind and spray protection device comprises a front panel positioned in front of the console.

15. The boat of claim 13, wherein the wind and spray protection device comprises a second member selectively coupled to and extending between the floor and the roof, a second side panel coupled to the second member and extending between the console and the sidewall, wherein a second actuator is configured to rotate the second side panel with respect to the console.

16. The boat of claim 13, wherein second side panel is opposed from the first side panel with the console positioned therebetween.

17. The boat of claim 15, wherein the second actuator is coupled between the second member and the second side panel.

18. The boat of claim 13, wherein the second actuator is configured to rotate the second member.

19. The boat of claim 10, wherein the first actuator is configured to be disengaged from the first panel by a manual release.

20. A wind and spray protection device configured to be selectively coupled to a boat comprising a floor, a sidewall, a console coupled to the floor and separated from the sidewall, and a roof wherein the wind and spray protection device includes a first member configured to be selectively coupled to and extend between the floor and the roof, a first side panel coupled to the first memI er and configured to extend between the console and the sidewall, wherein a first actuator is configured to rotate the first side panel with respect to the console.

* * * * *